US011344171B2

(12) United States Patent
Kung et al.

(10) Patent No.: US 11,344,171 B2
(45) Date of Patent: May 31, 2022

(54) FLOOR SURFACE CLEANING MACHINE AND CLEANING METHOD USING THE SAME

(71) Applicant: UNI-RING TECH. CO., LTD., Kaohsiung (TW)

(72) Inventors: Ching-Yun Kung, Tainan (TW); Hsuan-Fan Wang, Tainan (TW); Mao-Yi Lee, Tainan (TW)

(73) Assignee: UNI-RING TECH. CO., LTD., Kaohsiung (TW)

( * ) Notice: Subject to any disclaimer, the term of this patent is extended or adjusted under 35 U.S.C. 154(b) by 614 days.

(21) Appl. No.: 16/246,124

(22) Filed: Jan. 11, 2019

(65) Prior Publication Data

US 2019/0216284 A1 Jul. 18, 2019

(30) Foreign Application Priority Data

Jan. 12, 2018 (TW) ..... 107101329

(51) Int. Cl.
*A47L 11/40* (2006.01)
*A47L 11/30* (2006.01)

(52) U.S. Cl.
CPC ..... *A47L 11/305* (2013.01); *A47L 11/4013* (2013.01); *A47L 11/4016* (2013.01); *A47L 11/4044* (2013.01); *A47L 11/4066* (2013.01); *A47L 11/4072* (2013.01); *A47L 11/4088* (2013.01)

(58) Field of Classification Search
CPC ..... A47L 11/30; A47L 11/40; A47L 11/4088
See application file for complete search history.

(56) References Cited

U.S. PATENT DOCUMENTS 4,380,844 A * 4/1983 Waldhauser ..... A47L 11/30 15/320
4,492,002 A * 1/1985 Waldhauser ..... A47L 11/30 15/320
2003/0019068 A1* 1/2003 Field ..... A47L 11/4083 15/320

FOREIGN PATENT DOCUMENTS

CN 200958203 Y 10/2007
CN 103866728 A 6/2014
CN 104224048 A 12/2014
(Continued)

OTHER PUBLICATIONS

Search Report appended to an Office Action, which was issued to Chinese counterpart application No. 201810455387.8 by the CNIPA dated Jul. 30, 2020, with an English translation thereof.
(Continued)

*Primary Examiner* — Michael D Jennings
(74) *Attorney, Agent, or Firm* — Muncy, Geissler, Olds & Lowe, P.C.

(57) ABSTRACT

A floor surface cleaning machine includes a suction mechanism disposed at a bottom side of a machine frame for suction of dust and dirt on the floor surface, a brush mechanism disposed at the bottom side of the machine frame rearwardly of the suction mechanism for brushing the floor surface with cleaning liquid, and a squeegee unit disposed at the bottom side of the machine frame rearwardly of the brush mechanism for gathering dirty liquid. Before brushing the floor surface, fibers may be removed from the floor surface together with the dust and dirt for preventing the fibers from being tangled up with bristles of the brush mechanism.

15 Claims, 6 Drawing Sheets

(56) References Cited

FOREIGN PATENT DOCUMENTS

| | | | |
|---|---|---|---|
| CN | 106175613 | A | 12/2016 |
| CN | 106419729 | A | 2/2017 |

OTHER PUBLICATIONS

The Search Report appended to an Office Action, which was issued to Taiwanese counterpart application No. 107101329 by the TIPO dated May 14, 2019.
Screenshots from Youtube Video, "Operation Introduction to Gadlee GT110 Super Silent Ride-On Scrubber Dryer", URL: https://www.youtube.com/watch?v=8jHQLDzTwjQ, published on Apr. 12, 2016.
Screenshots from Youtube Video, "Jonas 1900 Ride-on Vacuum-Sweeper, Hako, Germany" URL: https://www.youtube.com/watch?v=EOhX76iP-ng, published on Jan. 20, 2014.

* cited by examiner

FLOOR SURFACE CLEANING MACHINE AND CLEANING METHOD USING THE SAME

CROSS-REFERENCE TO RELATED APPLICATION

This application claims priority from Taiwanese invention patent application no. 107101329, filed on Jan. 12, 2018.

FIELD

The disclosure relates to a floor surface cleaning machine, more particularly to a floor surface cleaning machine which may clean the floor surface in a more effective manner, and a cleaning method using the floor surface cleaning machine.

BACKGROUND

Taiwanese patent publication No. 341109, corresponding to counterpart U.S. Pat. No. 5,918,346, discloses a conventional floor surface cleaning machine for cleaning a floor surface. The conventional floor surface cleaning machine includes a machine body, a handle for manipulation, a pair of front wheels, a pair of driving wheels, a rotatable brush which is rotated for brushing the floor surface by a motor, and two tanks which are for a cleaning liquid and a dirty liquid, respectively, and which are located in the machine body, a feed liquid tube for feeding the cleaning liquid coming through an inlet port under the effect of a pump to the rotatable brush, a squeegee assembly for gathering dirty liquid resulting from rotational cleaning operation of the rotatable brush, and a blower for applying a sucking force on the interior of the dirty liquid tank to force the gathered dirty liquid to be collected in the dirty liquid tank through a vacuum hose.

When cleaning the floor surface using the conventional floor surface cleaning machine, fibers (such as hair fibers, carpet fibers or the like) on the floor surface might become tangled up with the bristles of the rotatable brush, which may undesirably reduce the cleaning effect.

SUMMARY

An object of the disclosure is to provide a novel floor surface cleaning machine for cleaning a floor surface in a more effective manner. A cleaning method using the floor surface cleaning machine is also provided.

According to a first aspect of the disclosure, a floor surface cleaning machine includes a machine frame, a propelling unit, and a cleaning unit. The propelling unit is disposed at a bottom of the machine frame to propel the machine frame to move on a floor surface. The cleaning unit is disposed at the bottom of the machine frame and includes a suction mechanism disposed at a front side of said bottom, a squeegee mechanism disposed at a rear side of the bottom, and a brush mechanism disposed between the suction mechanism and the squeegee mechanism.

According to a second aspect of the disclosure, a cleaning method using a floor surface cleaning machine is provided. The floor surface cleaning machine is propelled along an advancing direction on a floor surface to across a predetermined surface region of the floor surface. The cleaning method includes the steps of:

(i) removing dust and dirt on the predetermined surface region using a suction mechanism of the floor surface cleaning machine to permit to the dust and dirt to be collected in a dust collection box of the floor surface cleaning machine;

(ii) brushing the predetermined surface region using a brush mechanism of the surface cleaning machine while applying a cleaning liquid to the brush mechanism; and (iii) gathering and removing dirty liquid resulting from the brushing action on the predetermined surface region using a squeegee mechanism of the floor surface cleaning mechanism to permit to the gathered dirty liquid to be collected in a dirty liquid zone of the floor surface cleaning mechanism.

According to a third aspect of the disclosure, a floor surface cleaning machine using the cleaning method is provided.

According to a fourth aspect of the disclosure, a floor surface cleaning machine includes a machine frame, a suction head, a dust collection box, a vacuum air stream generating member, a brush mechanism, a drive unit, at least one distribution nozzle, a pump, a squeegee unit, a dirty liquid collector, and a suction force generating member. The machine frame is provided with wheels to permit the machine frame to be rollable on a floor surface. The suction head is disposed at a bottom side of the machine frame, and has an internal port and a suction nozzle which is disposed upstream of the internal port for confronting the floor surface. The dust collection box is mounted inside the machine frame and defines therein a collecting space. The dust collection box has a communicating port disposed downstream of the internal port and upstream of the collecting space to permit a vacuum air stream from the suction nozzle to flow therethrough so as to allow dust and dirt entrained in the vacuum air stream to be collect in the collecting space. The vacuum air stream generating member is disposed inside the machine frame and downstream of the dust collection box to generate the vacuum air stream which flows from the suction nozzle through the dust collection box. The brush mechanism is disposed at the bottom side of the machine frame rearwardly of the suction head, and is configured to be driven to brush the floor surface. The drive unit is disposed inside the machine frame, and is coupled to drive the brush mechanism. The cleaning liquid reservoir is disposed in the machine frame, and is configured for accommodating cleaning liquid. The distribution nozzle is disposed downstream of the cleaning liquid reservoir for distributing the cleaning liquid to the brush mechanism. The pump is disposed downstream of the cleaning liquid reservoir and upstream of the distribution nozzle to pump the cleaning liquid to the brush mechanism. The squeegee unit is disposed at the bottom side of the machine frame rearwardly of the brush mechanism for gathering dirty liquid on the floor surface. The dirty liquid collector is disposed inside the machine frame downstream of the squeegee unit, and defines therein a receiving space for receiving the gathered dirty liquid. The suction force generating member is disposed upstream of the receiving space to vacuum the receiving space so as to generate a suction force for drawing the gathered dirty liquid into the receiving space.

With the provision of the floor surface cleaning machine of the disclosure, before brushing the floor surface, fibers (such as hair fibers, carpet fibers or the like) may be removed from the floor surface together with the dust and dirt, so as to prevent the fibers from being tangled up with bristles of the brush mechanism. Therefore, the floor surface cleaning machine may be useful in cleaning the floor surface in a more effective manner.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Referring to FIGS. 1 to 4, a floor surface cleaning machine according to an embodiment of the disclosure is shown to include a machine frame (A), a cleaning unit (C), a negative-pressure generating unit (D), and a collector unit (E).

The cleaning unit (C) is disposed at a bottom (A10) of the machine frame (A) (see FIG. 1), and includes a suction mechanism (C1) disposed at a front side of the bottom (A10), a squeegee unit (C3) disposed at a rear side of the bottom (A10), and a brush mechanism (C2) disposed between the suction mechanism (C1) and the squeegee mechanism (C3).

The negative-pressure generating unit (D) is disposed inside said machine frame (A), and includes a first negative-pressure mechanism (D1) (i.e., a vacuum air stream generating member), a second negative-pressure mechanism (D2) (i.e., a suction force generating member), and a pump (D3).

The collector unit (E) is disposed inside said machine frame (A), and includes a dust collection box (E1) and a liquid container unit (E2). The liquid container unit (E2) includes a cleaning liquid reservoir (E23) and a dirty liquid collector (E21) and defines therein a cleaning liquid zone (E231) and a dirty liquid zone (E211).

The machine frame (A) is provided with wheels (B2) to permit the machine frame (A) to be rollable on a floor surface (W).

Figure 2:
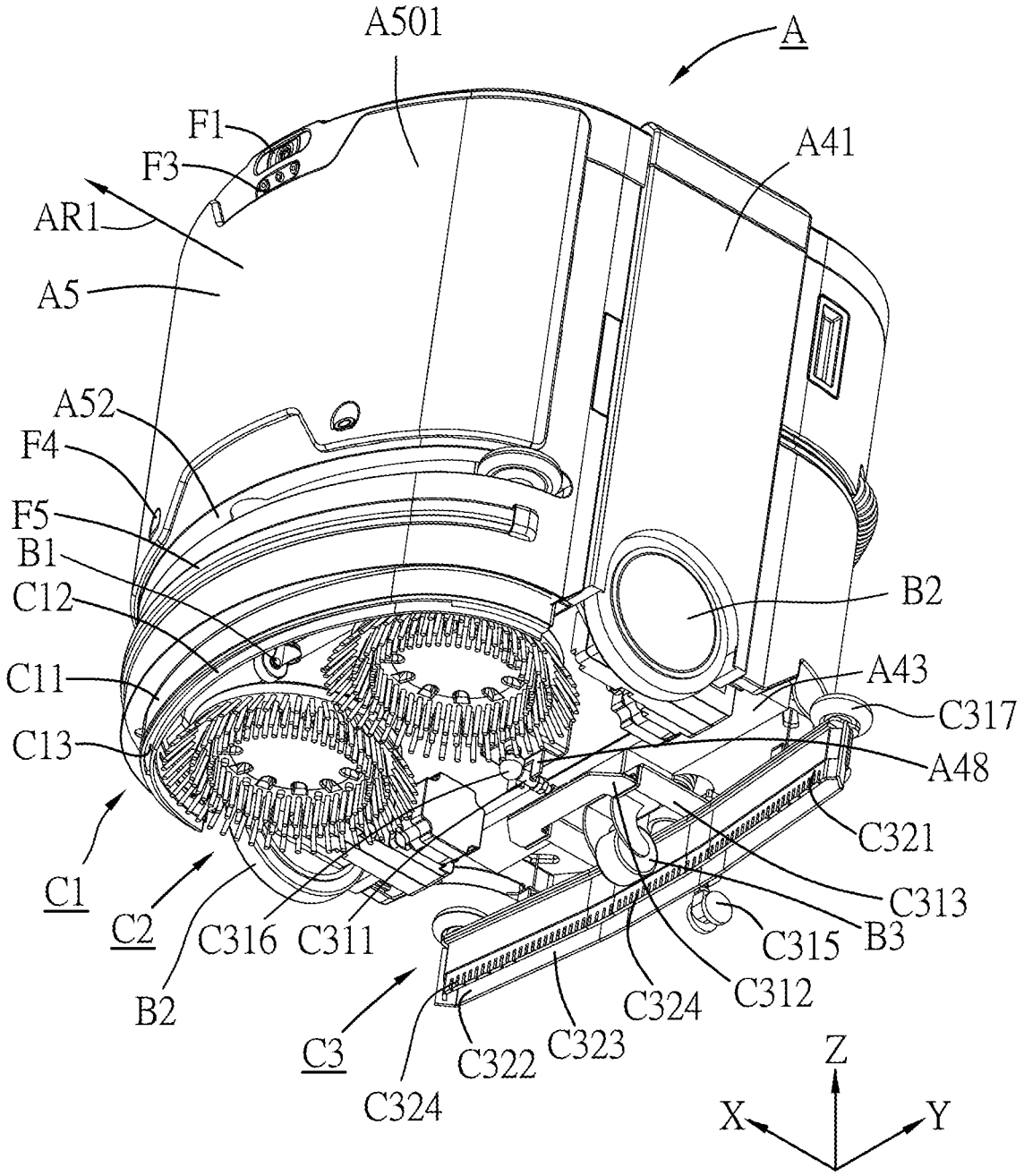
FIG. 2 is a bottom perspective view of the floor surface cleaning machine.
Figure 3:
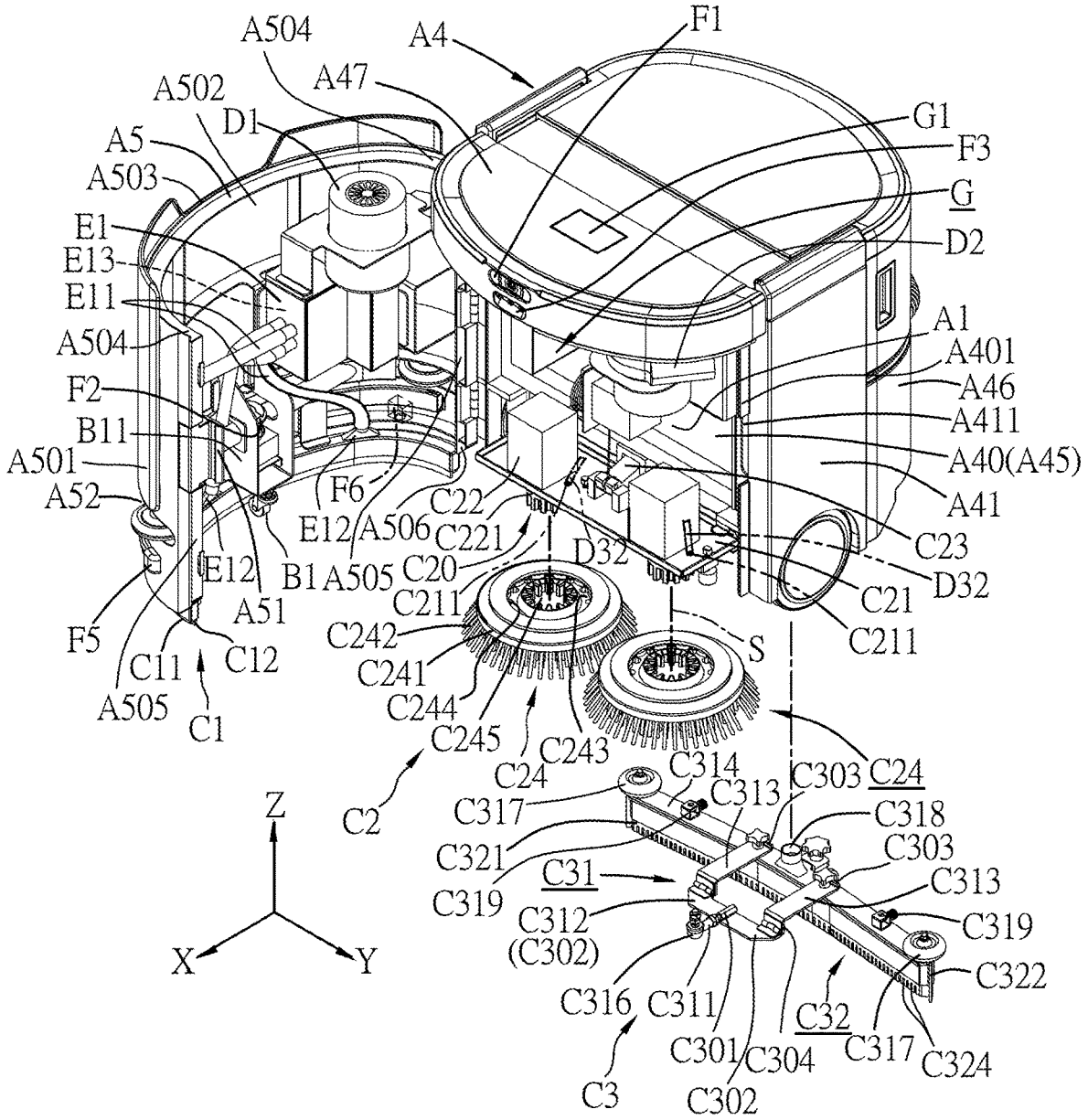
FIG. 3 is a partially exploded perspective view showing brush members and a squeegee unit of the floor surface cleaning machine.
Figure 4:
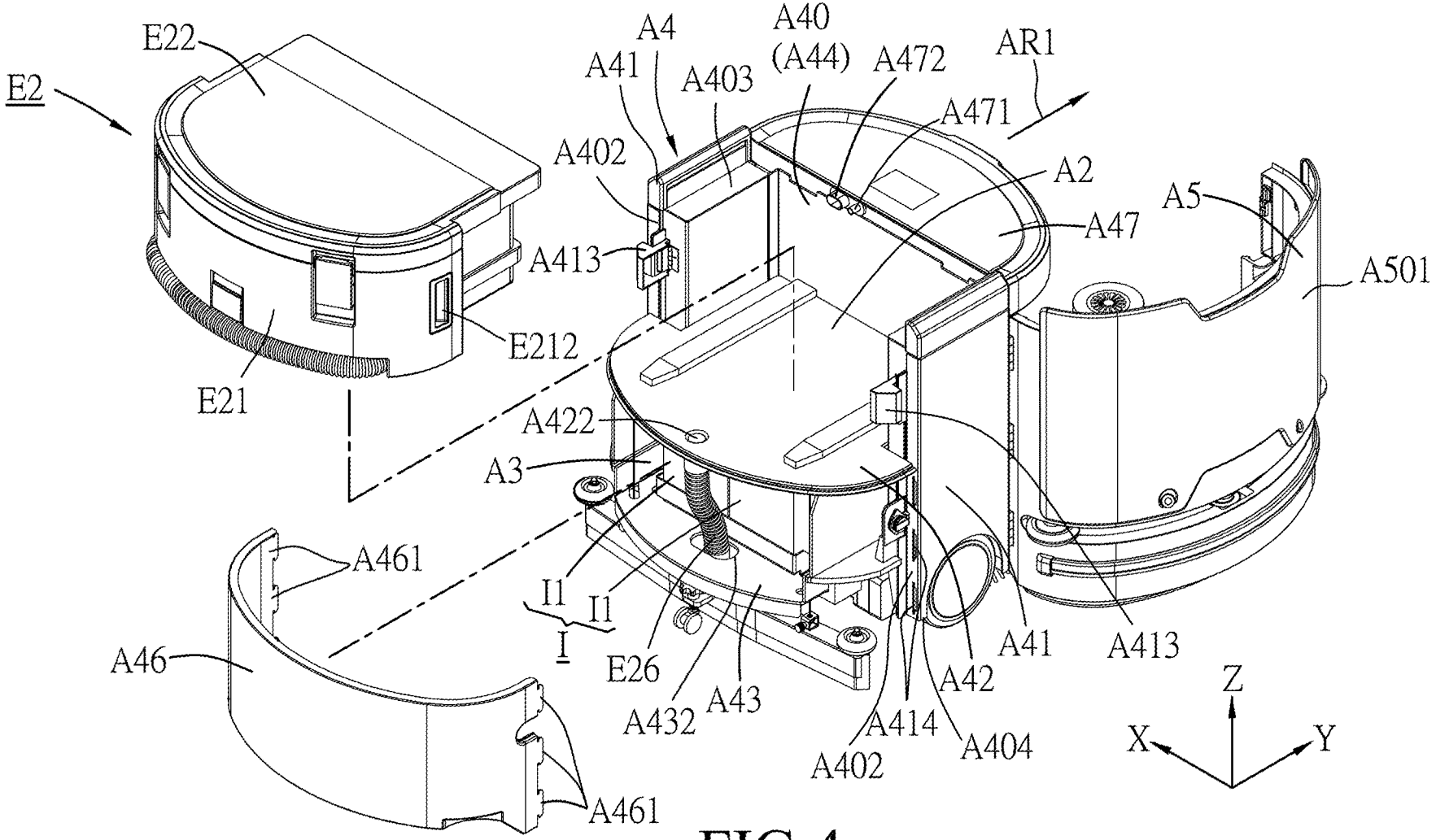
FIG. 4 is another partially exploded perspective view showing second and third chambers of the floor surface cleaning machine.
Figure 5:
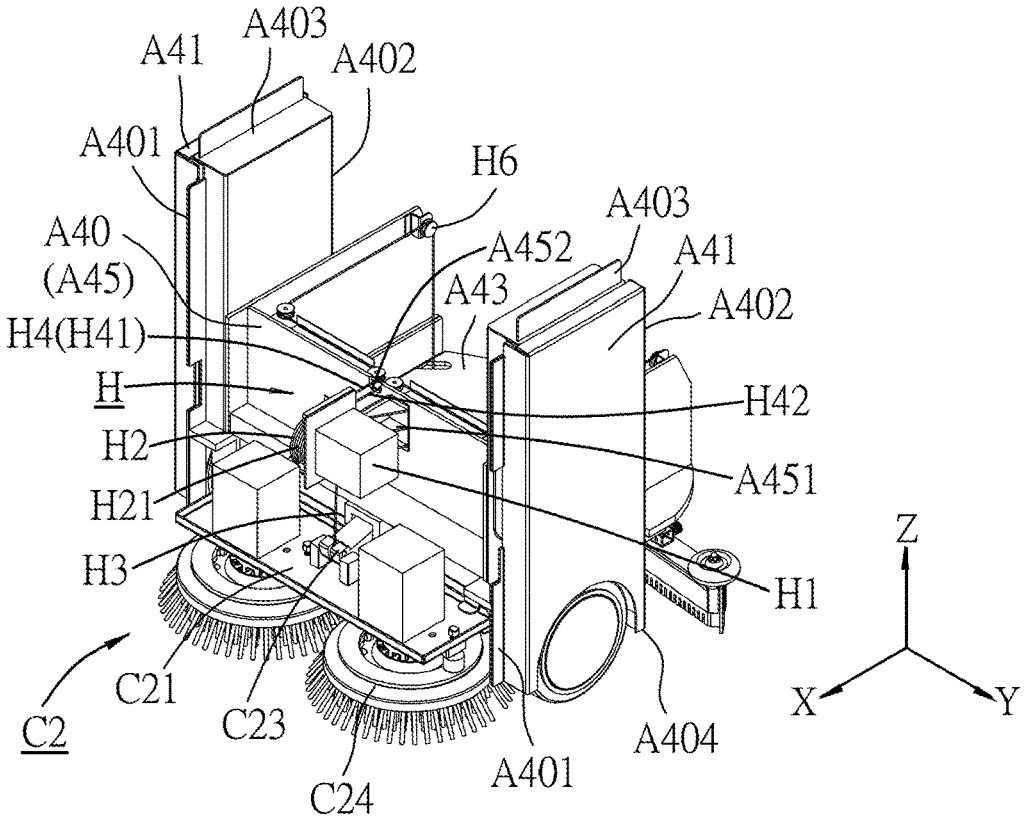
FIG. 5 is a partial front perspective view illustrating the brush members.

In an embodiment shown in FIGS. 3 to 5, the machine frame (A) includes a main body (A4) and a cover shell (A5). The main body (A4) is disposed at a rear side in an advancing direction of the machine frame (A) (i.e., a front-to-rear direction (X)) along an arrow (AR1) shown in FIG. 2. The cover shell (A5) is disposed at a front side in the advancing direction.

In an embodiment shown in FIGS. 3 to 5, the main body (A4) includes two sidewalls (A41), a vertical partition wall (A40), an upper stage (A42), and a lower stage (A43).

As shown in FIG. 5, the sidewalls (A41) are spaced apart from each other in a left-to-right direction (Y). Each of the sidewalls (A41) extends in the front-to-rear direction (X) to terminate at a front marginal edge (A401) and a rear marginal edge (A402), and extends in an upright direction (Z) to terminate at an upper marginal edge (A403) and a lower marginal edge (A404).

The vertical partition wall (A40) is disposed to span in the left-to-right direction (Y) between the sidewalls (A41) in proximity to the front marginal edges (A401) of the sidewalls (A41). In an embodiment shown in FIGS. 3 to 5, the vertical partition wall (A40) includes an upper wall segment (A44) and a lower wall segment (A45).

The upper stage (A42) is disposed to span in the left-to-right direction (Y) between the sidewalls (A41) to define a second chamber (A2) and a third chamber (A3) rearwardly of the vertical partition wall (A40) (see FIG. 4). In an embodiment, the second chamber (A2) is bordered by the upper wall segment (A44) (see FIG. 4), and the third chamber (A3) is bordered by the lower wall segment (A45) (see FIG. 6).

The lower stage (A43) is disposed to span in the left-to-right direction (Y) between the sidewalls (A41) in proximity to the lower marginal edges (A404) of the sidewalls (A41) so as to border the third chamber (A3).

As shown in FIG. 3, the cover shell (A5) has an outer shell surface (A501) and an inner shell surface (A502), and has an arc-shaped appearance. In details, the cover shell (A5) includes a base shell segment (A503) and two lateral segments (A504). The two lateral segments (A504) are disposed at two sides of the base shell segment (A503) opposite in the left-to-right direction (Y), and extend rearwardly to respectively terminate at two shell edges (A505) configured to be respectively coupled to the front marginal edges (A401) of the sidewalls (A41) so that the cover shell (A5), together with the vertical partition wall (A40), defines a first chamber (A1). The cover shell (A5) has a bottom marginal region (A506).

In an embodiment shown in FIGS. 3 and 5, one of the shell edges (A505) is hingedly connected to one of the front marginal edges (A401) of the sidewalls (A41), and the other one of the shell edges (A505) is detachably coupled to the other one of the front marginal edges (A401). Therefore, the cover shell (A5) can be opened for cleaning or repairing the elements inside the first chamber (A1) and be closed to enclose the first chamber (A1).

In an embodiment, as shown in FIGS. 3 and 5, the other one of the front marginal edges (A401) is formed with an engaging rib (A411), while the other one of the shell edges (A505) is formed with a resilient tab (A51) configured to be brought into clipping engagement with the engaging rib (A411).

In an embodiment shown in FIG. 4, the main body (A4) further includes a lower faceplate (A46) which is arc-shaped for enclosing the third chamber (A3), and which has two marginal edges each having a plurality of inserts (A461) configured to be respectively press-fitted into slits (A414) formed in the rear marginal edge (A402) of a respective one of the sidewalls (A41).

In an embodiment shown in FIGS. 3 and 4, the main body (A4) further includes a plate member (A47) disposed between the cover shell (A5) and the vertical partition wall (A40) to border the first chamber (A1). The plate member (A47) has two interconnecting ports (A471, A472).

The suction mechanism (C1) is disposed at a bottom side of the machine frame (A), and includes a suction head (also referred to by the symbol (C1) in FIGS. 2 and 3). The suction head (C1) has an internal port (E12) (see FIG. 3) and a suction nozzle (C13) (see FIG. 2). The suction nozzle (C13) is disposed upstream of the internal port (E12) for confronting the floor surface (W).

In an embodiment shown in FIGS. 2 and 3, the suction mechanism (C1) is mounted on the bottom marginal region (A506).

In an embodiment shown in FIGS. 2 and 3, the suction nozzle (C13) extends along the bottom marginal region (A506) of the cover shell (A5).

In an embodiment shown in FIGS. 2 and 3, the suction head (C1) includes a front lip portion (C11) and a rear lip portion (C12), which define therebetween the suction nozzle (C13), and which are disposed remote from and close to the floor surface (W), respectively, so as to ensure thorough drawing of dust and dirt into the suction head (C1) through the suction nozzle (C13).

The dust collection box (E1) is mounted inside the machine frame (A) and defines therein a collecting space (E13). The dust collection box (E1) has a communicating port (E14) (only shown in FIG. 1) disposed downstream of the internal port (E12) (see FIG. 3) and upstream of the collecting space (E13) to permit a vacuum air stream from the suction nozzle (C13) to flow therethrough so as to allow the dust and dirt entrained in the vacuum air stream to be collect in the collecting space (E13).

Figure 1:
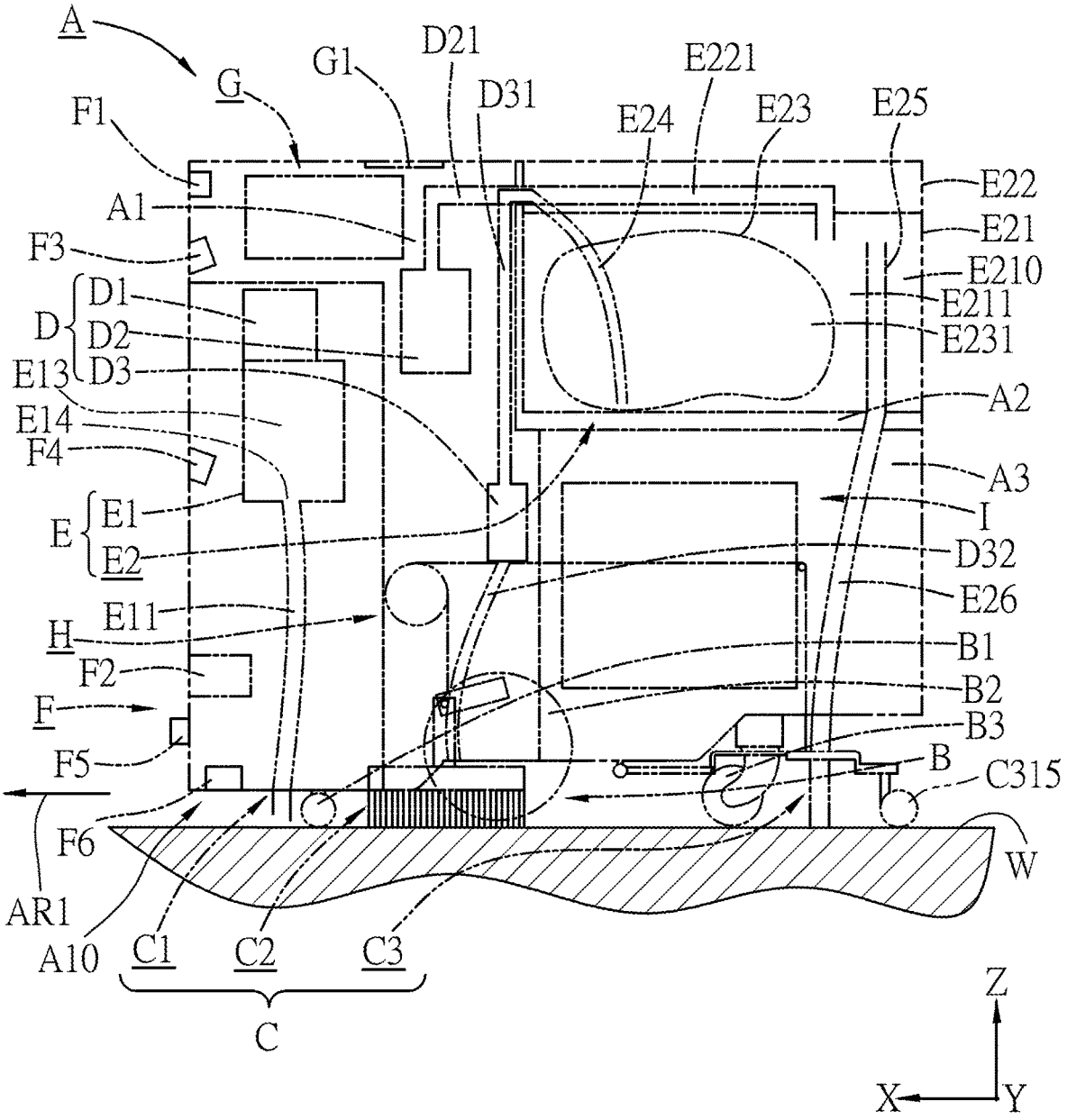
FIG. 1 is a schematic view illustrating a floor surface cleaning machine according to an embodiment of the disclosure.

In an embodiment shown in FIGS. 1 and 3, the dust collection box (E1) is mounted on the inner shell surface (A502) of the cover shell (A5), and the communicating port (E14) is connected to the internal port (E12) through a pipe (E11).

In an embodiment shown in FIG. 3, a plurality of the internal ports (E12) may be evenly distributed in the suction head (C1), and a plurality of the pipes (E11) may be provided for respectively interconnecting the internal ports (E12) and the communicating port (E14).

The vacuum air stream generating member (D1) is disposed inside the machine frame (A) and downstream of the dust collection box (E1) to generate the vacuum air stream which flows from the suction nozzle (C13) through the dust collection box (E1). In an embodiment shown in FIG. 3, the vacuum air stream generating member (D1) is disposed on the inner shell surface (A502).

In an embodiment, as illustrated in FIGS. 3 and 5, a mount member (C21) is disposed at the bottom side of the machine frame (A) to span between the cover shell (A5) and the vertical partition wall (A40) for bordering the first chamber (A1).

In an embodiment, the mount member (C21) is movable in the upright direction (Z).

The brush mechanism (C2) is disposed at the bottom side of the machine frame (A) rearwardly of the suction head (C1), and is configured to be driven to brush the floor surface (W).

In an embodiment shown in FIG. 3, a drive unit (C20) is disposed inside the machine frame (A), and is coupled to drive the brush mechanism (C2).

In an embodiment shown in FIG. 3, the brush mechanism (C2) includes at least one brush member (C24) which is rotatably mounted under the mount member (C21), and which is configured to be driven to rotate so as to brush the floor surface (W). In addition, the drive unit (C20) includes at least one drive member (C22) disposed on the mount member (C21) in the first chamber (A1), and having an output shaft (C221) which extends along a shaft axis (S) through the mount member (C21) and which is configured to be coupled to drive the brush member (C24) to rotate.

In an embodiment shown in FIG. 3, the brush member (C24) includes a brush head (C241), a plurality of bristles (C242), a bearing hole (C245), a surrounding groove (C243), and a plurality of dripping passages (C244).

The brush head (C241) has an upper surface and a lower surface opposite to the upper surface in the upright direction (Z).

The bristles (C242) are mounted on the lower surface of the brush head (C241) for brushing the floor surface (W).

The bearing hole (C245) is formed in the upper surface of the brush head (C241), and extends along the shaft axis (S) to be in splined engagement with the output shaft (C221) so as to permit the brush member (C24) to be driven by the drive unit (C20) to rotate about the shaft axis (S).

The surrounding groove (C243) is formed in the upper surface of the brush head (C241), and extends about the shaft axis (S). The surrounding groove (C243) is disposed downstream of a distribution nozzle (C211) to permit cleaning liquid to be introduced in the surrounding groove (C243).

Each of the dripping passages (C244) extends from a bottom of the surrounding groove (C243) to the lower surface of the brush head (C241), and is configured to permit the introduced cleaning liquid to drip into the bristles (C242) for brushing the floor surface (W) with the cleaning liquid.

In an embodiment shown in FIG. 3, the drive unit (C20) includes two of the drive members (C22) each of which is a drive motor, and the brush mechanism (C2) includes two of the brush members (C24) which may be coupled to be driven by the drive members (C22) to rotate in clockwise and counterclockwise directions, respectively, so as to direct the liquid on the floor surface (W) toward a middle zone between the brush members (C24) for facilitate gathering of dirty liquid resulting from brushing action of the brush members (C24).

The cleaning liquid reservoir (E23) is disposed in the machine frame (A), and defines an interior space (E231) (i.e., the cleaning liquid zone) configured for accommodating the cleaning liquid. The cleaning liquid may be water, detergent, a mixture of water and detergent, or the like.

In an embodiment shown in FIG. 1, the cleaning liquid reservoir (E23) is disposed in the second chamber (A2) upstream of the brush member(s) (C24).

The distribution nozzle (C211) is disposed downstream of the cleaning liquid reservoir (E23) and the pump (D3) and upstream of the brush mechanism (C2) for distributing the cleaning liquid to the brush mechanism (C2).

In an embodiment shown in FIG. 3, two of the distribution nozzles (C211) are disposed under the mount member (C21) for distributing the cleaning liquid to the brush members (C24), respectively.

The pump (D3) is disposed downstream of the cleaning liquid zone (E231) of the cleaning liquid reservoir (E23) and upstream of the distribution nozzle(s) (C211) to pump the cleaning liquid to the brush mechanism (C2). In an embodiment shown in FIG. 1, the pump (D3) is disposed in the first chamber (A1).

The squeegee unit (C3) is disposed at the bottom side of the machine frame (A) rearwardly of the brush mechanism (C2) for gathering the dirty liquid on the floor surface (W).

Figure 6:
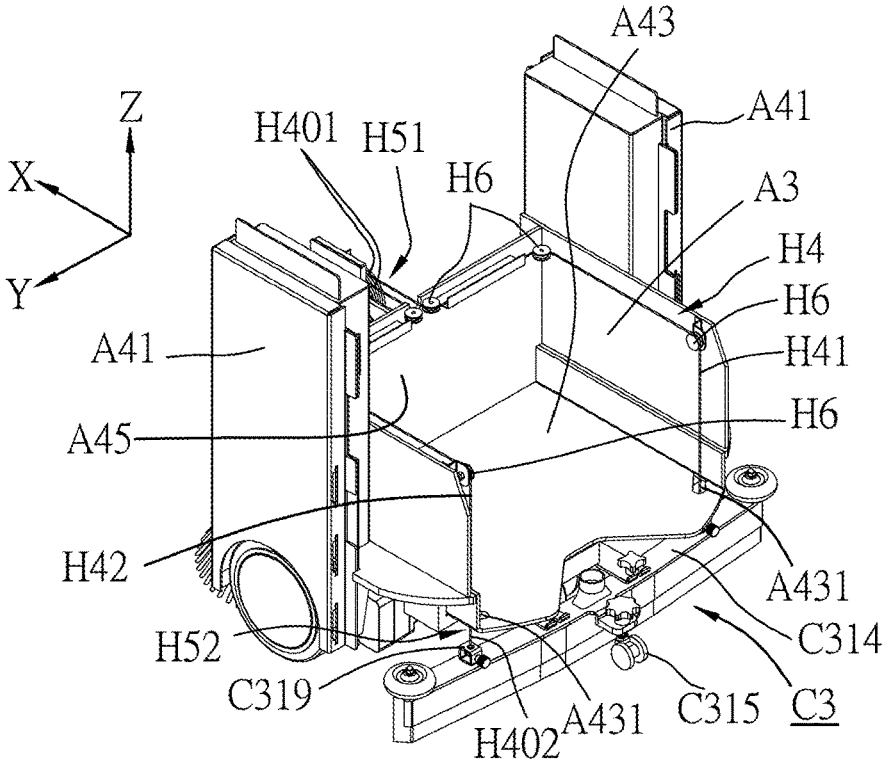
FIG. 6 is a partial rear perspective view illustrating the squeegee unit.

In an embodiment shown in FIG. 6, the squeegee unit (C3) is mounted under the lower stage (A43).

In an embodiment shown in FIGS. 2 and 3, the squeegee unit (C3) is hinged relative to the lower stage (A43), and includes a supporting mechanism (C31) and a squeegee mechanism (C32).

The supporting mechanism (C31) may include a connection pin member (C311), a crosspiece (C312), two connection arms (C313), and an elongated roof piece (C314).

The elongated roof piece (C314) is formed with an interconnection port (C318) upstream of the dirty liquid zone (E211) shown in FIG. 1.

The connection pin member (C311) extends in the front-to-rear direction (X) to terminate at a rear connection end (C301) and a front end segment (C316) which is configured to form a universal joint with the bottom side of the machine frame (A).

The crosspiece (C312) extends in the left-to-right direction (Y) to terminate at two piece end regions (C302). The rear connection end (C301) is secured on the crosspiece (C312) between the piece end regions (C302).

Each of the connection arms (C313) extends in the front-to-rear direction (X) to terminate at a coupling end (C303) and a bent end (C304). The coupling ends (C303) of the connection arms (C313) are secured on the elongated roof piece (C314) at two opposite sides of the interconnection port (C318). The bent ends (C304) of the connection arms (C313) are hingedly connected to the piece end regions (C302) of the crosspiece (C312), respectively, so as to permit the squeegee unit (C3) to be hinged relative to the lower stage (A43). In addition, if a small obstacle is disposed on the floor surface (W), the floor surface cleaning machine with such supporting mechanism (C31) allows the squeegee mechanism (C32) to cross such obstacle.

In an embodiment shown in FIGS. 1 and 6, the supporting mechanism (C31) may further include a rolling caster (C315) which is coupled to and disposed rearwardly of the elongated roof piece (C314), and which is rollable on the floor surface (W). The rolling caster (C315) is spaced apart from the squeegee mechanism (C32).

In an embodiment shown in FIGS. 2 and 3, a pair of side rollers (C317) are provided on the elongated roof piece (C314) to prevent side end portions of the elongated roof piece (C314) from scouring against a lower portion of a wall when the floor surface cleaning machine is used for cleaning a portion of the floor surface lying close to such wall.

In an embodiment shown in FIG. 2, a limit member (A48) is coupled to the connection pin member (C311) to limit angular movement of the squeegee unit (C3) about the universal joint (C316).

The squeegee mechanism (C32) may include a leading elongated scraper blade (C321) and a trailing elongated scraper blade (C322).

The leading elongated scraper blade (C321) is mounted beneath the elongated roof piece (C314), and has a lower marginal edge formed with a plurality of spaced apart vertical apertures (C324) upstream of the interconnection port (C318).

The trailing elongated scraper blade (C322) is mounted beneath the elongated roof piece (C314) to define, together with the leading elongated scraper blade (C321), a vacuum zone (C323) (shown in FIG. 2) upstream of the interconnection port (C318) and downstream of the vertical apertures (C323) so as to permit the gathered dirty liquid to be drawn into the receiving space (E210) shown in FIG. 1 through the vertical apertures (C323).

Furthermore, each of the leading and trailing elongated scraper blades (C321, C322) may be made from a flexible material, and is slightly curved forward at the sides.

As shown in FIG. 1, the dirty liquid collector (E21) is disposed inside the machine frame (A) downstream of the squeegee unit (C3), and defines therein a receiving space (E210) with the dirty liquid zone (E211) for receiving the gathered dirty liquid.

In an embodiment shown in FIG. 1, the dirty liquid collector (E21) is disposed in the second chamber (A2), and the liquid container unit (E2) may further include a cover plate (E22) enclosing the receiving space (E210).

In an embodiment shown in FIG. 1, the dirty liquid collector (E21) is fitted in the second chamber (A2) and the cleaning liquid reservoir (E23) is in form of a flexible pouch disposed in the receiving space (E210) of the dirty liquid collector (E21). In addition, a pipe (E24) is disposed in the flexible pouch (E23) and is connected to an upper connection pipe (D31) of the pump (D3) through the interconnecting port (A471) (only shown in FIG. 4). The pump (D3) is further connected to the distribution nozzles (C211) through a pair of lower connection pipes (D32) (see also FIG. 1).

The suction force generating member (D2) is disposed upstream of the receiving space (E210) to vacuum the receiving space (E210) so as to generate a suction force for drawing the gathered dirty liquid into the receiving space (E210).

In an embodiment shown in FIGS. 1 and 3 to 4, the suction force generating member (D2) is disposed in the first chamber (A1). A pipe (D21) is disposed to interconnect the suction force generating member (D2) and the interconnecting port (A472) (only shown in FIG. 4), while another pipe (E221) mounted to the cover plate (E22) is disposed to interconnect the interconnecting port (A472) and the receiving space (E210). Furthermore, a vacuum hose extends through passing holes (A422, A432) (only shown in FIG. 4) of the upper and lower stages (A42, A43) and includes an upper hose segment (E25) disposed inside the receiving space (E210) and a lower hose segment (E26) connected to the interconnection port (C318) so as to permit the dirty liquid gathered by the squeegee unit (C3) to be introduced into the receiving space (E210).

In an embodiment shown in FIG. 4, two retaining members (A413) are respectively formed on the rear marginal edges (A402) in proximity to the upper marginal edges (A403) of the sidewalls (A41). In addition, an outer surface of the collector housing (E21) is formed with two locking holes (E212) (only one is shown in FIG. 4). When the dirty liquid collector (E21) is fitted in the second chamber (A2), the retaining members (A413) are snap-fitted in the locking holes of the locking holes (E212), respectively.

In an embodiment, as shown in FIGS. 1 and 4, the floor surface cleaning machine further includes a power unit (I) disposed in the third chamber (A3) to supply electricity to the vacuum air stream generating member (D1), the drive unit (C20), the pump (D3), and the suction force generating member (D2). The position of the power unit (I) in the third chamber (A3) lowers the center of gravity of the floor surface cleaning machine.

In an embodiment, as shown in FIG. 4, the power unit (I) includes two rechargeable batteries (I1).

In an embodiment, the machine frame (A) may be propelled by a propelling unit (B) to move on the floor surface (W). As shown in FIGS. 1 and 2, the propelling unit (B) may be disposed at the bottom (A10) of the machine frame (A), and may include the wheels (B2) as shown FIGS. 1 and 2.

In an embodiment shown in FIGS. 1 and 2, the wheels (B2) are rotatably mounted under the sidewalls (A41), respectively, and are coupled to be driven by electricity from the rechargeable batteries (I1) so as to permit the floor surface cleaning machine to serve as a cleaning robot.

In an embodiment shown in FIGS. 1 to 3, the floor surface cleaning machine may further include a front caster (B1) and a rear caster (B3) for facilitating movement of the machine frame (A) on the floor surface (W). The front caster (B1) is mounted to the inner shell surface (A502) through an inner fixture (B11), and is disposed between the rear lip portion (C12) and the mount member (C21). The rear caster (B3) is mounted to the lower surface of the lower stage (A43).

In an embodiment shown in FIGS. 3 and 5 to 7, the floor surface cleaning machine may further include an elevation unit (H) including a servomotor (H1), a synchronizing roller (H2), a front pulling rope unit (H3), and a rear pulling rope unit (H4).

The servomotor (H1) is mounted on the vertical partition wall (A40) in the first chamber (A1), and is powered by the power unit (I).

Figure 7:
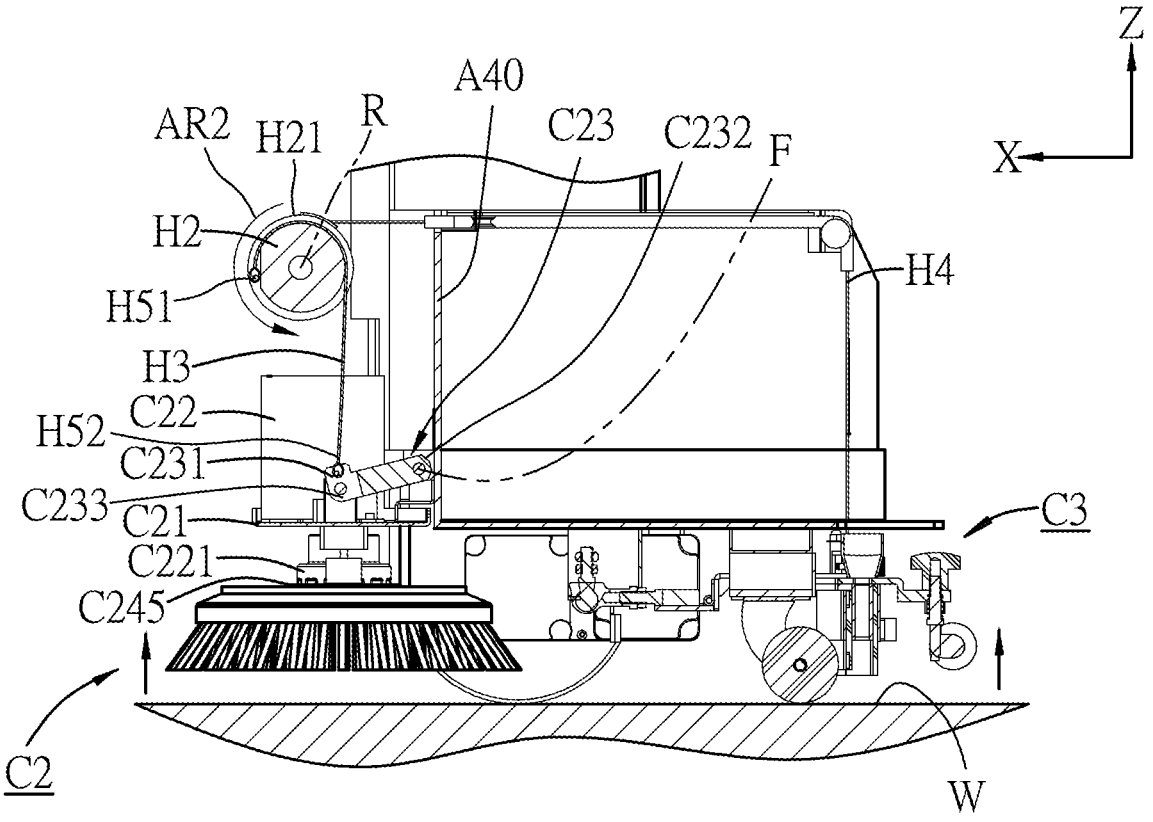
FIG. 7 is a fragmentary partial cross sectional view of the floor surface cleaning machine.

The synchronizing roller (H2) is coupled to be driven by the servomotor (H1) to turn a predetermined degree (shown by an arrow (AR2) in FIG. 7) about a roller axis (R) (shown in FIG. 7 only).

In an embodiment shown in FIG. 5, the servomotor (H1) and the synchronizing roller (H2) are mounted to the lower wall segment (A45) of the vertical partition wall (A40) through a mounting fixture (A451).

Each of the front and rear pulling rope units (H3, H4) has a coupled end (H51) which is secured to the synchronizing roller (H2) offset from the roller axis (R), and a pulling end (H52) which is coupled to a respective one of the mount member (C21) and the squeegee unit (C3). When the synchronizing roller (H2) is driven by the servomotor (H1) to turn the predetermined degree, the mount member (C21) and the squeegee unit (C3) are respectively and synchronously pulled by the front and rear pulling rope units (H3, H4) from a working position, where the brush mechanism (C2) and the squeegee unit (C3) are in contact with the floor surface (W), to a raised position (FIG. 7), where the brush mechanism (C2) and the squeegee unit (C3) are raised from the floor surface (W).

In an embodiment shown in FIGS. 3 and 7, the floor surface cleaning machine further includes a lever member (C23) which has a power region (C231), a fulcrum region (C232), and a weight region (C233).

The power region (C231) is secured to the pulling end (H52) of the front pulling robe unit (H3).

The fulcrum region (C232) is pivotally mounted relative to the vertical partition wall (A40) about a fulcrum axis (F) (only shown in FIG. 7).

The weight region (C233) is pivotally mounted relative to the mount member (C21) and is angularly displaced from the power region (C231) about the fulcrum axis (F) to permit the mount member (C21) to be pulled by the front pulling cord unit (H3) to be moved to the raised position when the synchronizing roller (H2) is driven to turn the predetermined degree.

In an embodiment shown in FIGS. 5 and 6, the rear pulling cord unit (H4) may include two rear pulling cords (H41, H42) each having a first end (H401) and a second end (H402). The first ends (H401) of the two rear pulling cords (H41, H42) are secured to the synchronizing roller (H2) to serve as the coupled end (H51) of the rear pulling cord unit (H4). The second ends (H402) of the two rear pulling cords (H41, H42) are respectively coupled to two opposite sides of the squeegee unit (C3) to serve as the pulling end (H52) of the rear pulling cord unit (H4).

In an embodiment shown in FIGS. 3 and 6, the second ends (H402) of the two rear pulling cords (H41, H42) are respectively coupled to the elongated roof piece (C314) through two coupling members (C319).

In an embodiment shown in FIGS. 5 and 6, a plurality of pulleys (H6) may be provided for changing direction of the rear pulling cords (H41, H42), and a slot (A452) may be formed in the lower wall segment (A45) of the vertical partition wall (A40) for passing of the rear pulling cords (H41, H42). In addition, the lower stage (A43) may be formed with two holes (A431) for passing of the pulling cords (H41, H42).

In an embodiment shown in FIGS. 3 and 5 to 7, an outer peripheral surface of the synchronizing roller (H2) may be formed with three grooves (H21) to permit the coupled end (H51) of the front pulling rope unit (H3) and the first ends (H401) of the two rear pulling cords (H41, H42) to be respectively secured therein.

In an embodiment shown in FIG. 1, a sensing unit (F) may be disposed at a front side of the machine frame (A), and may function to detect an obstacle or a level difference on the floor surface (W) or function to create a map during cleaning. The sensing unit (F) may include a first visual sensor (F1) for creating a map, a laser sensor (F2) for creating a map, a second visual sensor (F3) for detecting a lower obstacle or a level difference on the floor surface (W), a first optical or supersonic sensor (F4) for detecting a higher obstacle, a contact sensor (F5) for detecting contact with an obstacle, and a second optical or supersonic sensor (F6) for detecting a level difference.

In an embodiment, as shown in FIG. 2, the first and second visual sensors (F1, F3) are mounted on a front margin of the plate member (A47). The laser sensor (F2) is mounted on the inner shell surface (A502) for sweep-scanning outside of the machine frame (A) through a detection window (A52) (see also FIG. 3). The first optical or supersonic sensor (F4) and the contact sensor (F5) are mounted on the outer shell surface (A501) of the cover shell (A5). The second optical or supersonic sensor (F6) may be formed on the bottom marginal region (A506) in proximity to the inner shell surface (A502) of the cover shell (A5) (see FIG. 3).

In an embodiment shown in FIGS. 1 and 3, a control unit (G) is mounted to the plate member (A47) in the first chamber (A1), and has an interface (G1) on an upper surface of the plate member (A47) for allowing human-computer interaction.

With the provision of the floor surface cleaning machine of the disclosure, before brushing the floor surface (W), fibers (such as hair fibers, carpet fibers or the like) may be removed from the floor surface (W) together with the dust and dirt so as to prevent the fibers from being tangled up with the bristles (C242) of the brush members (C24). Therefore, the floor surface cleaning machine may be useful in cleaning the floor surface (W) in a more effective manner.

A cleaning method using the floor surface cleaning machine is also provided according an embodiment of the disclosure. The floor surface cleaning machine is propelled along an advancing direction (X) on a floor surface (W) to across a predetermined surface region of the floor surface (W). The cleaning method includes steps (i), (ii), and (iii), and is described with reference to FIG. 1.

In step (i), dust and dirt on the predetermined surface region are removed using the suction mechanism (C1) of the floor surface cleaning machine to permit to the dust and dirt to be collected in the dust collection box (E1) of the floor surface cleaning machine.

In step (ii), the predetermined surface region is brushed using the brush mechanism (C2) of the surface cleaning machine In the meantime, the cleaning liquid is applied to the brush mechanism (C2).

In step (iii), the dirty liquid resulting from the brushing action on the predetermined surface region was gathered and removed using the squeegee mechanism (C3) of the floor surface cleaning mechanism to permit to the gathered dirty liquid to be collected in the dirty liquid zone (E211) of the floor surface cleaning mechanism.

In addition, in step (ii), the predetermined surface region is brushed by the two brush members (C24) which are driven to rotate in clockwise and counterclockwise directions, respectively, so as to direct the liquid on the floor surface (W) toward a middle zone between the brush members (C24).

A floor surface cleaning machine using the cleaning method is also provided according an embodiment of the disclosure.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A floor surface cleaning machine comprising:

a machine frame, a propelling unit disposed at a bottom of said machine frame to propel said machine frame to move on a floor surface;

a cleaning unit disposed at said bottom of said machine frame and including a suction mechanism disposed at a front side of said bottom, a squeegee mechanism disposed at a rear side of said bottom, and a brush mechanism disposed between said suction mechanism and said squeegee mechanism, said squeegee unit being configured for gathering dirty liquid on the floor surface;

a collector unit disposed inside said machine frame, and including a dust collection box which is disposed downstream said suction mechanism, a cleaning liquid zone configured for accommodating cleaning liquid, and a dirty liquid zone configured for receiving the gathered dirty liquid and disposed downstream of said squeegee mechanism; and a negative-pressure generating unit disposed inside said machine frame, and including a first negative-pressure mechanism disposed to permit dust and dirt on the floor surface to be collected in said dust collection box upon operation of said first negative-pressure mechanism, a pump disposed to pump the cleaning liquid to said brush mechanism, and a second negative-pressure mechanism disposed to permit the gathered dirty liquid to be directed to said dirty liquid zone upon operation of said second negative-pressure mechanism.

2. The floor surface cleaning machine according to claim 1, wherein said collector unit further includes a liquid container unit which defines therein said cleaning liquid zone and said dirty liquid zone;

said first negative-pressure mechanism is disposed downstream of said dust collection box;

said pump is disposed downstream of said cleaning liquid zone and upstream of said brush mechanism; and said second negative-pressure mechanism is disposed downstream of said dirty liquid zone.

3. The floor surface cleaning machine according to claim 2, wherein said suction mechanism includes a suction head having an internal port and a suction nozzle which is disposed upstream of said internal port for confronting the floor surface;

said dust collection box defines therein a collecting space, and has a communicating port disposed downstream of said internal port and upstream of said collecting space to permit a vacuum air stream from said suction nozzle to flow through said dust collection box so as to allow the dust and dirt entrained in the vacuum air stream to be collect in said collecting space;

said first negative-pressure mechanism is a vacuum air stream generating member disposed downstream of said dust collection box to generate the vacuum air stream which flows from said suction nozzle through said dust collection box;

said brush mechanism is configured to be driven to brush the floor surface;

said liquid container unit includes a cleaning liquid reservoir which defines therein said cleaning liquid zone for accommodating the cleaning liquid, and a dirty liquid collector which is disposed downstream of said squeegee unit, and which defines therein a receiving space with said dirty liquid zone for receiving the gathered dirty liquid; and said second negative-pressure mechanism is a suction force generating member disposed upstream of said receiving space to vacuum said receiving space so as to generate a suction force for drawing the gathered dirty liquid into said receiving space.

4. The floor surface cleaning machine according to claim 3, further comprising:

a drive unit disposed inside said machine frame, and coupled to drive said brush mechanism; and at least one distribution nozzle disposed downstream of said pump and upstream of said brush mechanism for distributing the cleaning liquid to said brush mechanism.

5. The floor surface cleaning machine according to claim 4, wherein said machine frame includes a main body disposed at a rear side in an advancing direction of said machine frame, and a cover shell disposed at a front side in the advancing direction.

6. The floor surface cleaning machine according to claim 5, further comprising a mount member disposed at a bottom side of said machine frame, wherein said main body includes two sidewalls spaced apart from each other in a left-to-right direction, each of said sidewalls extending in a front-to-rear direction to terminate at a front marginal edge and a rear marginal edge, and extending in an upright direction to terminate at an upper marginal edge and a lower marginal edge, a vertical partition wall spanning in the left-to-right direction between said sidewalls in proximity to said front marginal edges of said sidewalls, an upper stage spanning in the left-to-right direction between said sidewalls to define a second chamber and a third chamber rearwardly of said vertical partition wall, and a lower stage spanning in the left-to-right direction between said sidewalls in proximity to said lower marginal edges of said sidewalls so as to border said third chamber;

said cover shell has an outer shell surface and an inner shell surface, and includes a base shell segment, and two lateral segments which are disposed at two opposite sides of said base shell segment in the left-to-right direction, and which extend rearwardly to respectively terminate at two shell edges configured to be respectively coupled to said front marginal edges of said sidewalls so that the cover shell, together with said vertical partition wall, defines a first chamber, said cover shell having a bottom marginal region;

said suction head is mounted on said bottom marginal region;

said dust collection box is mounted on said inner shell surface;

said vacuum air stream generating member is disposed on said inner shell surface;

said mount member is disposed to span between said cover shell and said vertical partition wall to border said first chamber;

said brush mechanism includes at least one brush member which is rotatably mounted under said mount member, and which is configured to be driven to rotate so as to brush the floor surface;

said drive unit includes at least one drive member disposed on said mount member in said first chamber, and having an output shaft which extends along a shaft axis through said mount member and which is configured to be coupled to drive said brush member to rotate;

said cleaning liquid reservoir is disposed in said second chamber upstream of said brush member;

said distribution nozzle is disposed under said mount member for distributing the cleaning liquid to said brush member;

said squeegee unit is mounted under said lower stage;

said dirty liquid collector is disposed in said second chamber.

7. The floor surface cleaning machine according to claim 6, further comprising a power unit disposed in said third chamber to supply electricity to said vacuum air stream generating member, said drive unit, said pump, and said suction force generating member.

8. The floor surface cleaning machine according to claim 7, wherein said power unit includes at least one rechargeable battery, and said propelling unit includes two wheels which are rotatably mounted under said sidewalls, respectively, and which are coupled to be driven by electricity from said rechargeable battery so as to permit said floor surface cleaning machine to serve as a cleaning robot.

9. The floor surface cleaning machine according to claim 7, wherein said mount member is movable in the upright direction, and said squeegee unit is hinged relative to said lower stage, said floor surface cleaning machine further comprising:

a servomotor which is mounted on said vertical partition wall in said first chamber, and which is powered by said power unit;

a synchronizing roller coupled to be driven by said servomotor to turn about a roller axis a predetermined degree; and a front pulling rope unit and a rear pulling rope unit, each having a coupled end which is secured to said synchronizing roller offset from the roller axis, and a pulling end which is coupled to a respective one of said mount member and said squeegee unit such that when said synchronizing roller is driven by said servomotor to turn the predetermined degree, said mount member and said squeegee unit are respectively and synchronously pulled by said front and rear pulling rope units to a raised position from a working position.

10. The floor surface cleaning machine according to claim 9, wherein said floor surface cleaning machine further comprising a lever member which has a power region secured to said pulling end of said front pulling robe unit, a fulcrum region pivotally mounted relative to said vertical partition wall about a fulcrum axis, and a weight region pivotally mounted relative to said mount member and angularly displaced from said power region about the fulcrum axis to permit said mount member to be pulled by said front pulling cord unit to be moved to the raised position when said synchronizing roller is driven to turn the predetermined degree.

11. The floor surface cleaning machine according to claim 6, wherein one of said shell edges is hingedly connected to one of said front marginal edges of said sidewalls, and the other one of said shell edges is detachably coupled to the other one of said front marginal edges.

12. The floor surface cleaning machine according to claim 6, wherein said brush member includes a brush head having an upper surface and a lower surface opposite to said upper surface in the upright direction, a plurality of bristles mounted on said lower surface of said brush head for brushing the floor surface, a bearing hole formed in said upper surface of said brush head, and extending along the shaft axis, said bearing hole being configured to permit said brush member to be driven by said output shaft of said drive member to rotate about the shaft axis, a surrounding groove formed in said upper surface of said brush head, and extending about the shaft axis, said surrounding groove being disposed downstream of said distribution nozzle to permit the cleaning liquid to be introduced in said surrounding groove, and a plurality of dripping passages each extending from a bottom of said surrounding groove to said lower surface of said brush head, and each configured to permit the introduced cleaning liquid to drip into said bristles for brushing the floor surface with the cleaning liquid.

13. The floor surface cleaning machine according to claim 6, wherein said suction nozzle extends along said bottom marginal region of said cover shell.

14. The floor surface cleaning machine according to claim 13, wherein said suction head includes a front lip portion and a rear lip portion, which define therebetween said suction nozzle, and which are disposed remote from and close to the floor surface, respectively, so as to ensure drawing of the dust and dirt entirely into said suction head through said suction nozzle.

15. A floor surface cleaning machine comprising:

a machine frame provided with wheels to permit said machine frame to be rollable on a floor surface;

a suction head disposed at a bottom side of said machine frame, and having an internal port and a suction nozzle which is disposed upstream of said internal port for confronting the floor surface;

a dust collection box mounted inside said machine frame and defining therein a collecting space, said dust collection box having a communicating port disposed downstream of said internal port and upstream of said collecting space to permit a vacuum air stream from said suction nozzle to flow therethrough so as to allow dust and dirt entrained in the vacuum air stream to be collect in said collecting space;

a vacuum air stream generating member disposed inside said machine frame and downstream of said dust collection box to generate a vacuum air stream which flows from said suction nozzle through said dust collection box;

a brush unit disposed at said bottom side of said machine frame rearwardly of said suction head, and configured to be driven to brush the floor surface;

a drive unit disposed inside said machine frame, and coupled to drive said brush unit;

a cleaning liquid reservoir disposed in said machine frame, and configured for accommodating cleaning liquid;

at least one distribution nozzle disposed downstream of said cleaning liquid reservoir for distributing the cleaning liquid to said brush unit;

a pump disposed downstream of said cleaning liquid reservoir and upstream of said distribution nozzle to pump the cleaning liquid to said brush unit;

a squeegee unit disposed at said bottom side of said machine frame rearwardly of said brush unit for gathering dirty liquid on the floor surface;

a dirty liquid collector disposed inside said machine frame downstream of said squeegee unit, and defining therein a receiving space for receiving the gathered dirty liquid; and a suction force generating member disposed upstream of said receiving space to vacuum said receiving space so as to generate a suction force for drawing the gathered dirty liquid into said receiving space.

* * * * *